United States Patent [19]

Langer

[11] 4,417,104

[45] Nov. 22, 1983

[54] PLUG FOR MINIATURE RECEIVER

[75] Inventor: Adolf Langer, Vienna, Austria

[73] Assignee: Viennatone Gesellschaft M.B.H., Vienna, Austria

[21] Appl. No.: 398,666

[22] Filed: Jul. 15, 1982

[30] Foreign Application Priority Data

Aug. 14, 1981 [AT] Austria ..... 3570/81

[51] Int. Cl.[3] ..... H04R 25/00

[52] U.S. Cl. ..... 179/107 R; 181/129

[58] Field of Search ..... 181/129, 135, 137; 129/107 R, 107 E, 182 R; 128/152

[56] References Cited

U.S. PATENT DOCUMENTS 2,754,373 7/1956 Shaper ..... 179/107 R 3,999,177 12/1976 Greene ..... 179/182 R X

*Primary Examiner*—Benjamin R. Fuller

*Attorney, Agent, or Firm*—Kurt Kelman

[57] ABSTRACT

Plug for miniature receiver, especially for pocket hearing aids for the hard-of-hearing, with a plug body (7) and at least one plug pin (9) projecting out of the plug body (7). In order to avoid a gap between the receiver and the plugged-in plug, and therefore avoidance of escape of sound, it is suggested that the plug body (7) should be provided with a circumferential bulge (11, 14) of elastic material, surrounding the plug pin (or pins), which lies as a sealing ring on the receiver (1) when the plug is plugged in, thus acoustically sealing the gap between the receiver housing and the plugged-in plug.

3 Claims, 3 Drawing Figures

PLUG FOR MINIATURE RECEIVER

The invention concerns a plug for miniature receivers, especially pocket hearing aids for the hard-of-hearing, with a plug body and a plug pin projecting from the plug body.

Magnetic miniature receivers, held on the ear with a suitable arrangement, and connected with the broadcasting apparatus by means of a cable and plug are widely used, i.e. pocket radios, dictating machines and pocket hearing-aids.

Because of the method of construction of the majority of these miniature receivers, the sound produced is not fed into the ear by means of the actual sound outlet, but can also escape from the back of the receiver through the plugholes.

It is particularly important in hearing aids for the hard-of-hearing, and other similar arrangements that, in order to avoid acoustic feedback, the receiver is completely soundproof, i.e. none of the amplified sound can reach the microphone of the apparatus. This is particularly important in high-performance apparatus with correspondingly high amplification.

In spite of the standardization of the plugs (IEC 90) it cannot be avoided that a gap of a greater or smaller degree remains, through which part of the sound produced can escape.

In order to avoid this disadvantage, a small sealing disc of elastic material has already been suggested, the outer contours of which correspond with the dimensions of the plug, and which is simply threaded onto the plug pins by means of corresponding holes. As the plug is so standardized that it engages in the socket, the above provides sufficient seal in this way.

The disadvantage of this known arrangement is, however, that an additional sealing means is also necessary, that can easily be lost when the plug is often removed (e.g. when the receiver is cleaned as necessary).

It is the aim of the invention to avoid this disadvantage of the known arrangement. This is achieved, according to the invention, with the aid of a plug of the type described at the beginning, in that the plug body is surrounded by a bulge of elastic material, running circumferentially around the plug pin (or pins), which lies on the receiver body and acts as a sealing ring when the plug is plugged into the receiver, acoustically sealing the gap between the receiver housing and the plugged-in plug.

The invention is described below in more detail, with reference to the drawings.

Figure 1:
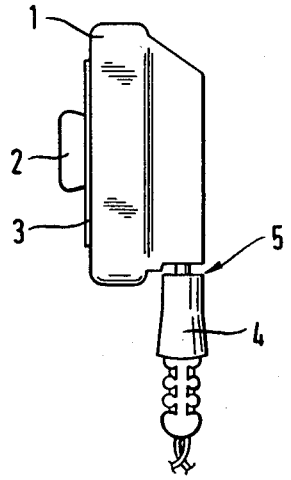
Figure 2:
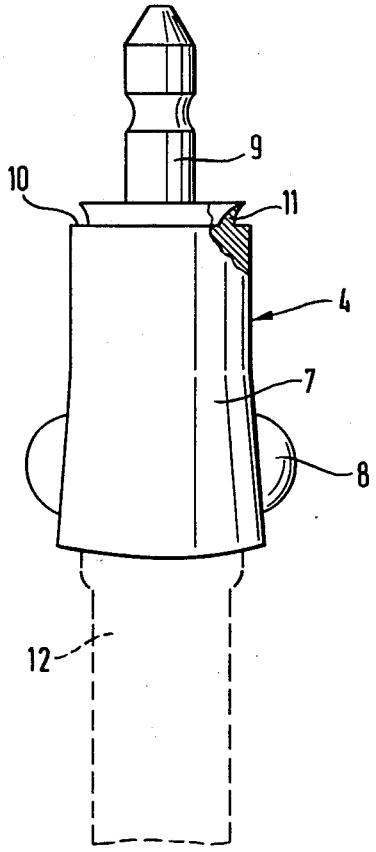
Figure 3:
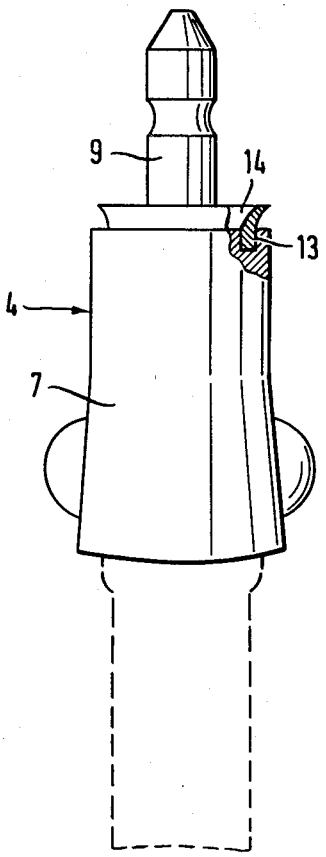

FIG. 1 shows view of a receiver of a deaf-hearing-aid with a known plug connection, and FIGS. 2 and 3 two embodiments of plus according to the invention, in partial cross-section.

In the known arrangement according to FIG. 1, a sealing disc 3 of soft-PVC or similar material is arranged in order to seal a receiver 1 around the press-stud-like sound outlet nipple 2, giving sufficiently good seal with regard to the ear cavity body which is pressed onto part 2. On the other hand, it cannot be avoided that a gap of more or less magnitude remains, allowing part of the sound produced to escape.

The invention suggests that the plug body itself should be provided with a sealing bulge which is in one piece with the plug body made of soft plastic, and therefore cannot be lost. FIG. 2 shows a view of the plug 4 according to the invention. The actual body 7 of the plug, made of soft plastic with gripping ribs 8 for easier removal, and injected plug pins 9, has extruded onto its fitting surface 10 a circumferential sealing bulge 11, the section of which is fin-shaped. 12 shows the kinking protection, formed in a known manner, for the injected cable (not shown).

When the plug 4 is plugged into the receiver, the sealing bulge 4 lies on the corresponding fitting joint of the receiver, and thus seals the unavoidable gap. As the bulge 11, like the whole plug 4, is made of soft plastic, sufficient elasticity is assured.

If for some reason it is not possible to form the whole plug body 7 out of soft plastic then, as a variation of the inventive idea, it is also possible to arrange a suitable circumferential groove 13 around the plug body 7 (see FIG. 3), in which the bulge-shaped seal 14 is set. As this seal is fixedly connected with the plug 4 by means of adhesive or injection, it fulfils the same purpose as in a plug according to FIG. 3.

I claim:

1. Plug for miniature receiver, especially for pocket hearing aids for the hard-of-hearing, with a plug body and at least one pin projecting from the plug body, characterized in that the plug body (7) is provided with a bulge (11, 14) running circumferentially around the plug pin (or pins) (9), of elastic material, which, when the plug is plugged into the receiver (1), acts as a gasket and lies on the receiver housing, whereby it acoustically seals the space between the receiver housing and the plugged in plug.

2. Plug according to claim 1, with a plug body of elastic material, characterized in that the whole plug (4) is made of elastic material, and the sealing bulge (11) is formed in one piece with the body of the plug (7) (FIG. 2).

3. Plug according to claim 1, characterized in that the sealing bulge (14) is of soft plastic or similar material, and is fixedly connected with the plug body (7) for adhesion or injection.

* * * * *